US008517521B2

(12) United States Patent
Sunouchi et al.

(10) Patent No.: US 8,517,521 B2
(45) Date of Patent: Aug. 27, 2013

(54) PRINTING APPARATUS

(75) Inventors: Shunya Sunouchi, Kawasaki (JP); Hiroyuki Tanaka, Kawasaki (JP); Takaya Sato, Kawasaki (JP); Seiji Suzuki, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 190 days.

(21) Appl. No.: 12/965,785

(22) Filed: Dec. 10, 2010

(65) Prior Publication Data

US 2011/0285795 A1 Nov. 24, 2011

(30) Foreign Application Priority Data

May 19, 2010 (JP) ..... 2010-115495

(51) Int. Cl.

| | |
|---|---|
| ***B41J 2/175*** | (2006.01) |
| ***B41J 2/165*** | (2006.01) |
| ***B41J 2/17*** | (2006.01) |
| ***B41J 2/18*** | (2006.01) |

(52) U.S. Cl.
USPC ..... 347/85; 347/36; 347/84; 347/89

(58) Field of Classification Search
USPC ..... 347/36, 84, 85, 89
See application file for complete search history.

(56) References Cited

U.S. PATENT DOCUMENTS

| | | | | |
|---|---|---|---|---|
| 6,312,094 | B1 | 11/2001 | Ito et al. | |
| 2010/0177148 | A1 * | 7/2010 | Asami | 347/85 |

* cited by examiner

*Primary Examiner* — Jannelle M Lebron
(74) *Attorney, Agent, or Firm* — Canon USA Inc IP Division

(57) ABSTRACT

A printing apparatus includes an overflow tube into which ink overflowed from a buffer tank flows, an overflow tank to which the overflow tube is connected, a drain tank to which ink is drained from the overflow tank, and an atmosphere communication port provided to the drain tank. The buffer tank communicates with the atmosphere through the atmosphere communication port.

8 Claims, 10 Drawing Sheets

PRINTING APPARATUS

BACKGROUND OF THE INVENTION

1. Field of the Invention

The present invention relates to a printing apparatus that prints an image on a sheet.

2. Description of the Related Art

An apparatus disclosed in U.S. Pat. No. 6,312,094 includes an overflow tube into which waste ink overflowed from an ink tank provided in the apparatus is introduced and an overflow tank capable of temporarily storing the waste ink introduced thereinto. Furthermore, the waste ink temporarily stored in the overflow tank is drainable through a general drain tube to a waste ink bottle.

In the apparatus disclosed in U.S. Pat. No. 6,312,094, however, when a large amount of ink overflows, the overflow tube cannot fully receive the overflowed ink. Consequently, the overflowed ink may spill from an air intake and may spread inside the apparatus.

SUMMARY OF THE INVENTION

The present invention provides a printing apparatus in which overflowed ink is prevented from spilling inside the printing apparatus and the occurrence of overflow of ink is detectable.

According to an aspect of the present invention, a printing apparatus has a print head configured to eject ink, a first storage tank configured to store the ink, and a second storage tank configured to store the ink supplied from the first storage tank. Ink that has not been ejected from the print head is collected into the first storage tank. The printing apparatus includes a first overflow tube into which ink overflowed from the first storage tank flows, an overflow tank to which the first overflow tube is connected, a drain tank to which ink is drained from the overflow tank, and an atmosphere communication port provided to the drain tank. The first storage tank communicates with the atmosphere through the atmosphere communication port.

Further features of the present invention will become apparent from the following description of exemplary embodiments with reference to the attached drawings.

DESCRIPTION OF THE EMBODIMENTS

An embodiment of the present invention concerning a printing apparatus employing an inkjet method will now be described. The printing apparatus according to the embodiment is a high-speed line printer performing printing on a long continuous sheet that is wound in a roll and capable of both simplex and duplex printing. The length of the continuous sheet in a conveyance direction is larger than that of a unit image. The printing apparatus is suitable for bulk printing performed in, for example, printing laboratories. The present invention is applicable to printing apparatuses such as a printer, a multifunctional printer, a copier, a facsimile, and the like.

Figure 1:
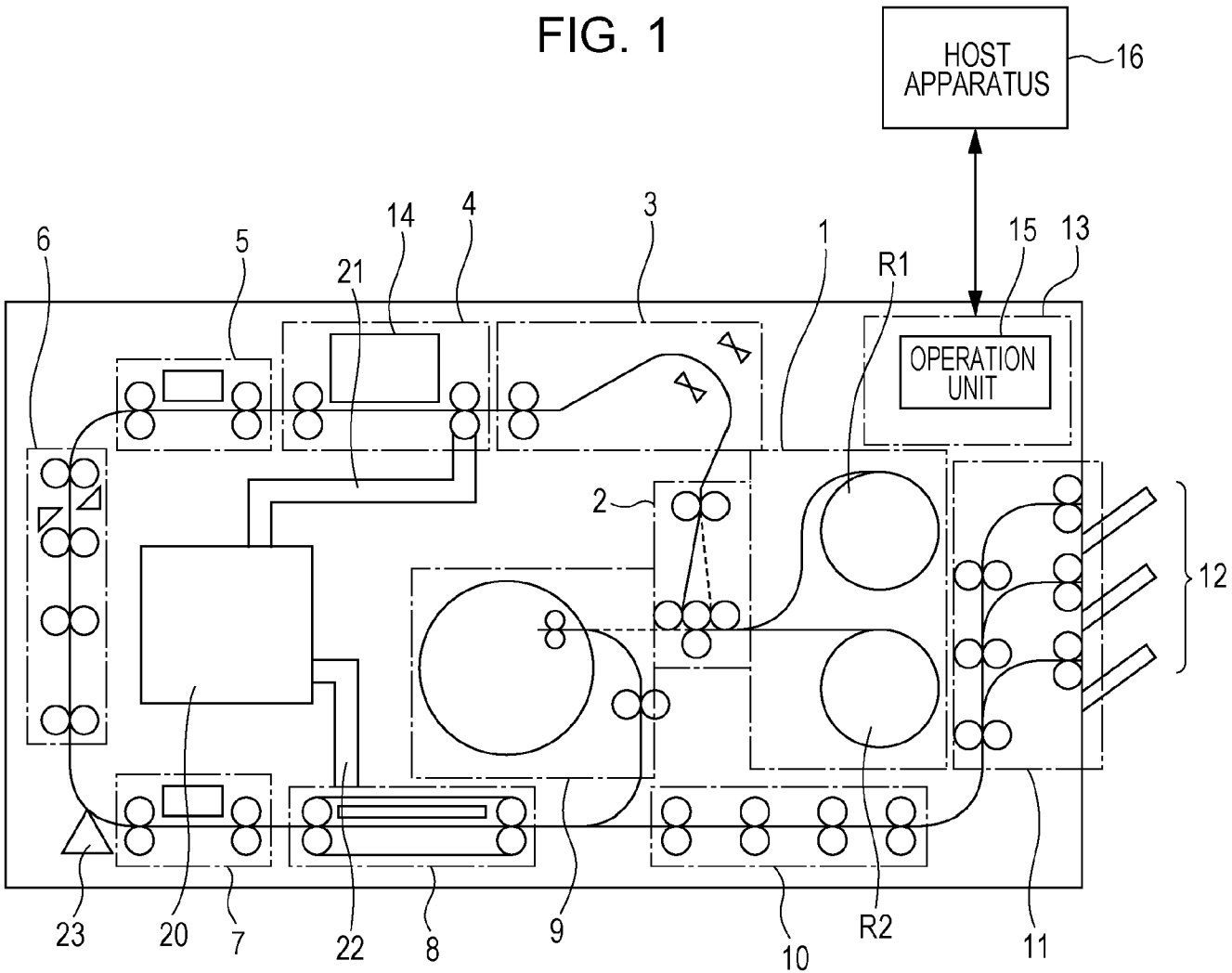
FIG. 1 is a schematic diagram showing the internal configuration of a printing apparatus.

FIG. 1 is a schematic cross-sectional view showing the internal configuration of a printing apparatus according to the embodiment. The printing apparatus is capable of performing duplex printing on a sheet that is wound in a roll, i.e., printing on first and second sides of the sheet, the second side being opposite the first side. The printing apparatus basically includes a sheet feeding unit 1, a decurling unit 2, a skew correcting unit 3, a printing unit 4, an inspecting unit 5, a cutting unit 6, an information recording unit 7, a drying unit 8, a reversing unit 9, a discharge-conveyance unit 10, a sorting unit 11, a discharge unit 12, a humidifying unit 20, and a control unit 13. The sheet is conveyed along a conveyance path, shown by the solid line in FIG. 1, by conveying mechanisms including pairs of rollers and belts, and is subjected to various processing operations performed by the foregoing units.

The sheet feeding unit 1 holds a continuous sheet that is wound in a roll and feeds the sheet. The sheet feeding unit 1 can house two rolls R1 and R2, from either of which the sheet is unwound to be fed. The number of rolls that can be housed in the sheet feeding unit 1 is not limited to two. The sheet feeding unit 1 may house only a single roll, or three or more rolls.

The decurling unit 2 reduces the curl of the sheet fed from the sheet feeding unit 1. The decurling unit 2 includes one driving roller and two pinch rollers. A decurling force is made to act on the sheet by causing the sheet to pass through the rollers in such a manner as to be bent in the direction opposite to the direction of the curl. Thus, the curl is reduced.

The skew correcting unit 3 corrects any skew of the sheet (an obliquity with respect to the original direction in which the sheet advances) that has passed through the decurling unit 2. The skew correcting unit 3 causes the sheet to be pressed at the reference side thereof against a guide member. Thus, the skew of the sheet is corrected.

The printing unit 4 performs printing with a plurality of print heads 14 from above on the sheet that is being conveyed, thereby forming an image on the sheet. That is, the printing unit 4 is a processing unit that performs a specific processing operation on the sheet. The printing unit 4 also includes a plurality of conveying rollers that convey the sheet. The print heads 14 are line print heads each having rows of inkjet nozzles provided in such a manner as to cover the width of the largest sheet among various sheets to be used. The print heads 14 are arranged parallel to each other and side by side in the conveyance direction. In the embodiment, four print heads 14 for four colors of cyan (C), magenta (M), yellow (Y), and black (K) are provided. The numbers of colors and print heads 14 are each not limited to four. Moreover, any of various inkjet methods may be employed, such as those employing heater devices, piezo devices, electrostatic devices, microelectromechanical systems (MEMS), and the like. Inks of the foregoing colors are supplied from ink tanks to the print heads 14 through ink tubes.

The inspecting unit 5 includes a scanner with which an inspection pattern and/or an image printed on the sheet by the printing unit 4 is optically read, and inspects the condition of the nozzles of the print heads 14, the state of conveyance of the sheet, the image position, and so forth, thereby determining whether or not an image has been printed correctly. The scanner includes a charge-coupled-device (CCD) image sensor, a complementary-metal-oxide-semiconductor (CMOS) image sensor, or the like.

The cutting unit 6 includes a mechanical cutter that cuts the sheet that has undergone printing into pieces of specific lengths. The cutting unit 6 also includes a plurality of conveying rollers that convey the cut pieces of the sheet toward the downstream side.

The information recording unit 7 records printing information (unique information), such as the serial number and the date of print, on a non-printed area of each cut sheet. The recording is performed by printing characters, codes, and/or the like by an inkjet method, a thermal transfer method, or the like. A sensor 23 that detects the leading end of each cut sheet is provided on the upstream side with respect to the information recording unit 7 and on the downstream side with respect to the cutting unit 6. That is, the sensor 23 detects the leading end of the sheet between the cutting unit 6 and a position where the information recording unit 7 performs recording. The timing for the recording of information by the information recording unit 7 is controlled on the basis of the detection by the sensor 23.

The drying unit 8 heats the sheet that has undergone printing performed by the printing unit 4, thereby quickly drying the ink on the sheet. In the drying unit 8, hot air is fed to the sheet that is being conveyed at least from below the sheet, whereby the side of the sheet having ink is dried. The drying method employed by the drying unit 8 is not limited to the method in which hot air is used and may be any of other methods, such as a method in which electromagnetic waves (ultraviolet rays, infrared rays, or the like) are applied to the surface of the sheet.

A conveyance path extending from the sheet feeding unit 1 to the drying unit 8 is referred to as a first path. The first path makes a U-turn in a portion thereof from the printing unit 4 to the drying unit 8. The cutting unit 6 is provided at a position in the U-turn.

In duplex printing, the reversing unit 9 temporarily winds up the continuous sheet that has undergone front-side printing, thereby reversing the front and back sides of the sheet. The reversing unit 9 is provided at a position in a path (a loop path, also referred to as a second path) extending from the drying unit 8 via the decurling unit 2 to the printing unit 4. The second path is intended for feeding the sheet that has passed through the drying unit 8 to the printing unit 4 again. The reversing unit 9 includes a rotatable winding rotary member around which the sheet is to be wound. The continuous sheet that has undergone front-side printing but is yet to be cut into pieces is temporarily wound around the winding rotary member. When the entirety of the sheet has been wound up, the winding rotary member rotates in the reverse direction, whereby the wound sheet is unwound and is fed to the decurling unit 2 and then to the printing unit 4. Since the sheet in this state has the front and back sides thereof reversed, the printing unit 4 can perform printing on the back side of the sheet. More specific operations performed in duplex printing will be described separately below.

The discharge-conveyance unit 10 conveys each cut sheet obtained by the cutting unit 6 and dried by the drying unit 8, and delivers the sheet to the sorting unit 11. The discharge-conveyance unit 10 is provided on a path (referred to as a third path) different from the second path on which the reversing unit 9 is provided. To selectively guide the sheet that has been conveyed from the first path to either of the second and third paths, a path switching mechanism including a movable flapper is provided at the point where the first path branches into the second and third paths.

The sorting unit 11 and the discharge unit 12 are provided on a lateral side with respect to the sheet feeding unit 1 and at the end of the third path. The sorting unit 11 sorts printed sheets according to need. The sorted sheets are discharged to the discharge unit 12 including a plurality of trays. Thus, the third path runs below the sheet feeding unit 1 and extends in such a manner as to discharge the sheet toward a side across the sheet feeding unit 1 from the printing unit 4 and the drying unit 8.

The humidifying unit 20 generates a humidified gas (air) and supplies the humidified gas to a space between the sheet and the print heads 14 of the printing unit 4. Thus, drying of ink in the nozzles of the print heads 14 is suppressed. The humidifying unit 20 may be of an evaporative type, a water spray type, a steam type, or the like. The evaporative type includes a rotary type, which is employed in the embodiment, a permeable membrane type, a drop pervaporation type, a capillary type, and the like. The water spray type includes an ultrasonic type, a centrifugal type, a high-pressure-spray type, a two-fluid-atomization type, and the like. The steam type includes a steam duct type, an electrothermal type, an electrode type, and the like. The humidifying unit 20 is connected to the printing unit 4 with a first duct 21 and to the drying unit 8 with a second duct 22. In the drying unit 8, a highly humid hot gas is generated when the sheet is dried. The gas is introduced into the humidifying unit 20 through the second duct 22, and is utilized as auxiliary energy for the generation of the humidified gas in the humidifying unit 20. The humidified gas generated in the humidifying unit 20 is introduced into the printing unit 4 through the first duct 21.

The control unit 13 controls the units included in the printing apparatus. The control unit 13 includes a controller, an external interface, and an operation unit 15. The controller includes a central processing unit (CPU), a memory, and various controllers. The user performs input and output operations on the operation unit 15. The operation of the printing apparatus is controlled on the basis of instructions from the controller or a host apparatus 16, such as a host computer, connected to the controller via the external interface.

Figure 2:
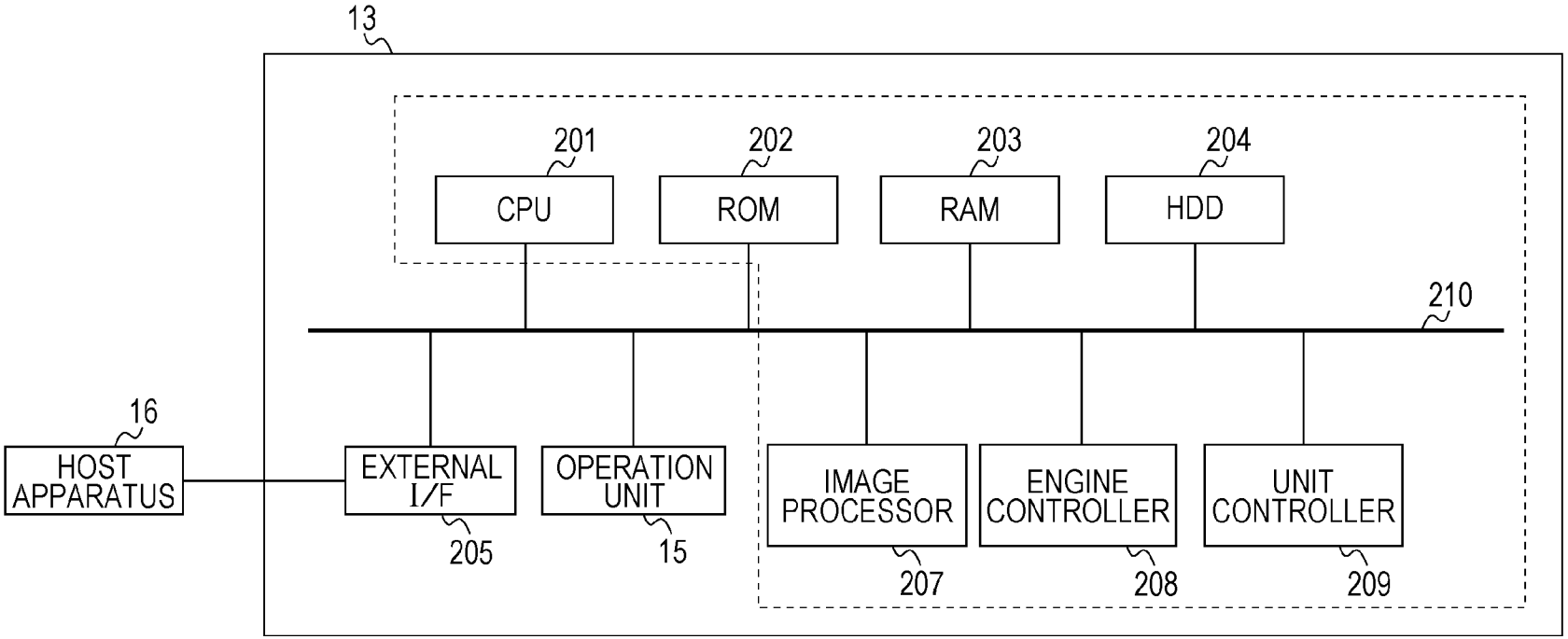
FIG. 2 is a block diagram of a control unit.

FIG. 2 is a block diagram showing the concept of the control unit 13. The controller (a section enclosed by the broken line) of the control unit 13 includes a CPU 201, a read-only memory (ROM) 202, a random access memory (RAM) 203, a hard disk drive (HDD) 204, an image processor 207, an engine controller 208, and a unit controller 209. The CPU 201 integrally controls the operations performed by the units included in the printing apparatus. The ROM 202 stores programs to be performed by the CPU 201 and fixed data necessary for the operations performed in the printing apparatus. The RAM 203 is used as a work area for the CPU 201, as a temporary storage area for various data received, and as a storage area for various setting data. Programs to be performed by the CPU 201, print data, and setting information necessary for operations performed in the printing apparatus can be stored in and be read from the HDD 204. The operation unit 15 is an input/output interface to the user and includes hard keys, input portions of a touch panel, a display on which information is displayed, and an output portion such as a sound generator. For example, in a case where a display with a touch panel is employed, the operation status, print status, maintenance information (the amount of ink remaining, the amount of sheet remaining, the maintenance status, and so forth) of the apparatus are displayed to the user. The user can input various pieces of information through the touch panel.

For units that are required to perform high-speed data processing, processors exclusive to such units are provided. The image processor 207 performs image processing of print data handled by the printing apparatus. Specifically, the color space (for example, YCbCr) of image data that has been input to the image processor 207 is converted into the standard RGB color space (for example, sRGB). Furthermore, the image data is subjected to various image processing operations, such as resolution conversion, image analysis, and image correction, according to need. Print data obtained through such image processing operations is stored in the RAM 203 or the HDD 204. In response to a control command received from the CPU 201 or the like, the engine controller 208 controls the driving of the print heads 14 of the printing unit 4 in accordance with the print data. The unit controller 209 is a sub-controller that controls the sheet feeding unit 1, the decurling unit 2, the skew correcting unit 3, the inspecting unit 5, the cutting unit 6, the information recording unit 7, the drying unit 8, the reversing unit 9, the discharge-conveyance unit 10, the sorting unit 11, the discharge unit 12, and the humidifying unit 20 individually. The operations of the foregoing units are individually controlled by the unit controller 209 on the basis of instructions from the CPU 201. An external interface (I/F) 205 is a local I/F or a network I/F that connects the controller and the host apparatus 16 to each other. The elements included in the control unit 13 are connected to each other with a system bus 210.

The host apparatus 16 is a source from which image data for causing the printing apparatus to perform printing is supplied. The host apparatus 16 may be a general-purpose or exclusive computer, or may be an exclusive imaging apparatus, such as an image capture, a digital camera, or a photo storage, having an image reader. If the host apparatus 16 is a computer, an operating system, application software that generates image data, and a print driver for the printing apparatus are installed on a storage device included in the computer. All of the processing operations described above may not necessarily be realized with software, and some or all of the processing operations may be realized with hardware.

A basic printing operation will now be described. Operations performed in simplex printing mode and duplex printing mode are different from each other and will be described individually.

Figure 3:
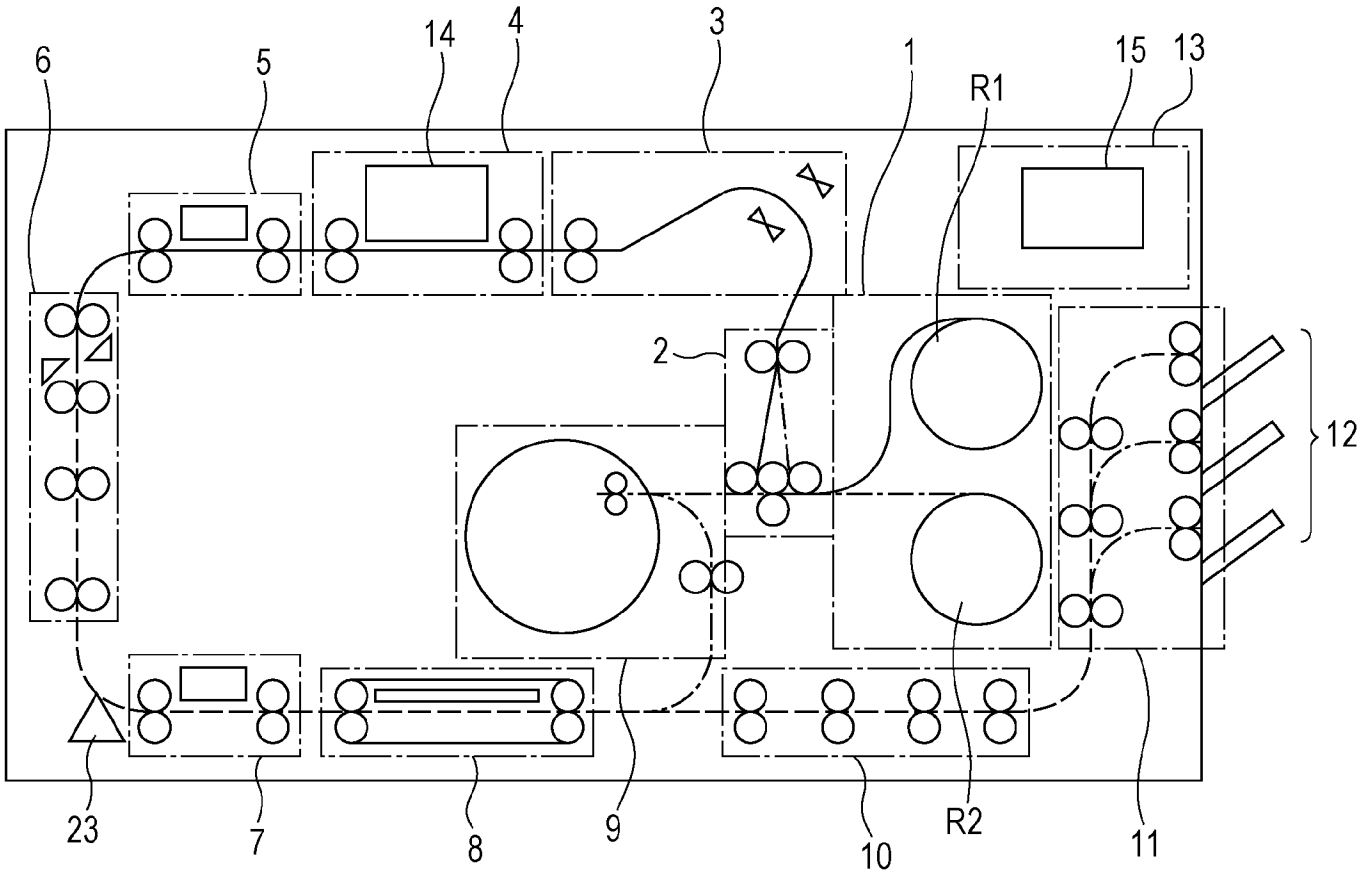
FIG. 3 is a diagram showing the operation performed in simplex printing mode.

FIG. 3 is a diagram showing the operation performed in simplex printing mode. The conveyance path along which a sheet fed from the sheet feeding unit 1 undergoes printing and is discharged to the discharge unit 12 is shown by the bold line. The sheet is fed from the sheet feeding unit 1, undergoes the respective processing operations in the decurling unit 2 and in the skew correcting unit 3, and further undergoes printing on the front side (the first side) thereof in the printing unit 4. Images (unit images) each having a specific unit length in the conveyance direction are sequentially printed on the sheet, which is a long continuous sheet, whereby a plurality of images are formed in order. The printed sheet is conveyed to the inspecting unit 5 and to the cutting unit 6, where the sheet is cut into pieces each having a unit image. According to need, the information recording unit 7 records printing information on the back side of each of the cut sheets obtained as described above, and the cut sheets are each conveyed to the drying unit 8 so as to be dried. Subsequently, the cut sheets are each conveyed through the discharge-conveyance unit 10, are sorted by the sorting unit 11, and are sequentially discharged and stacked onto the discharge unit 12. Meanwhile, the portion of the sheet remaining on the side of the printing unit 4 after the cutting for the last unit image is rewound into the sheet feeding unit 1, thereby being wound into the roll R1 or R2. Thus, in simplex printing, the sheet is conveyed and is processed along the first path and the third path, but is not conveyed along the second path.

Figure 4:
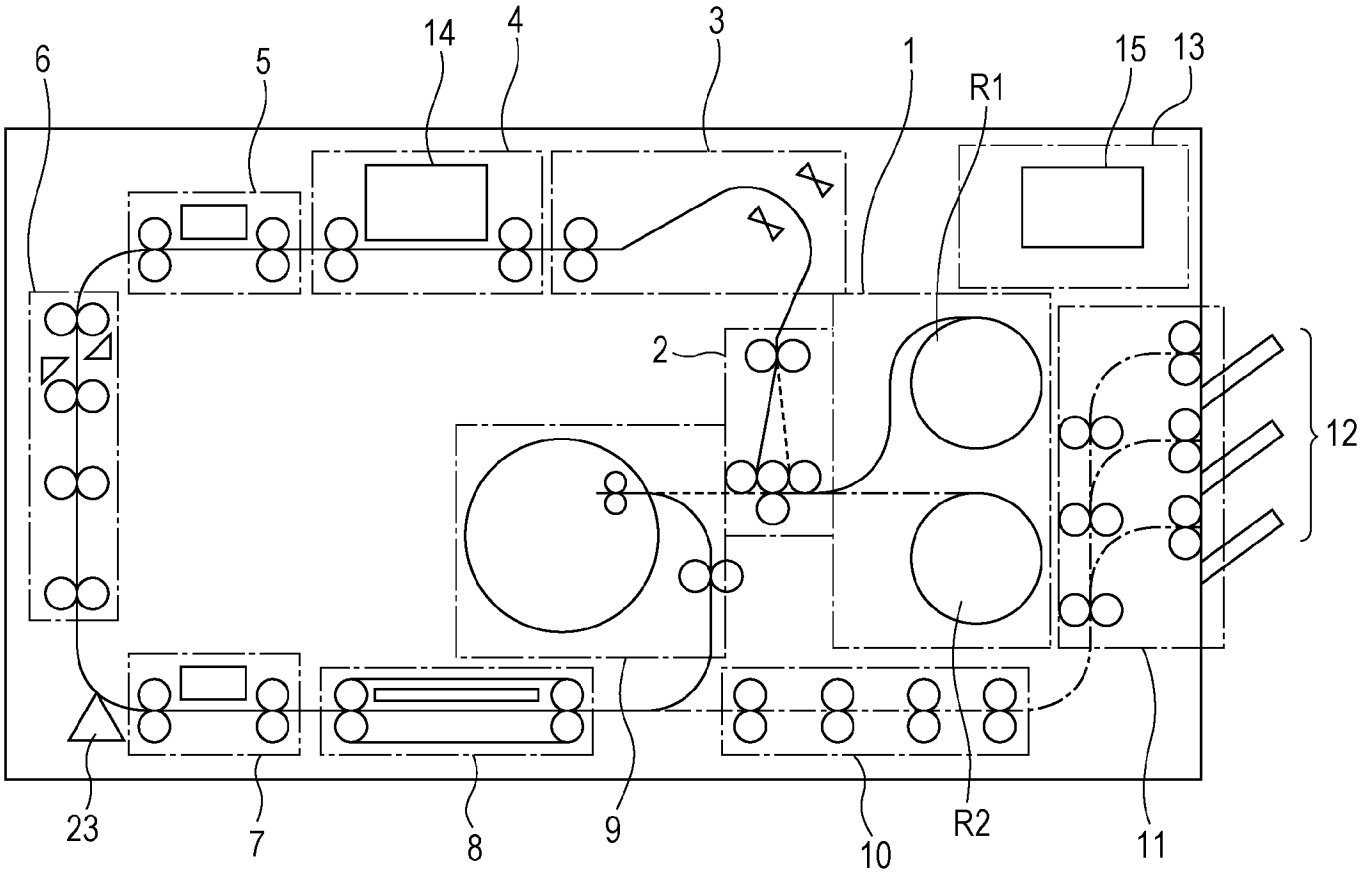
FIG. 4 is a diagram showing the operation performed in duplex printing mode.

FIG. 4 is a diagram showing the operation performed in duplex printing mode. In duplex printing, a front-side (first-side) printing sequence is performed first, and a back-side (second-side) printing sequence is subsequently performed. In the front-side printing sequence, individual operations performed by the units from the sheet feeding unit 1 to the inspecting unit 5 are the same as those performed in simplex printing. The cutting unit 6 does not perform cutting of the sheet by unit length, and the sheet is conveyed in the continuous state to the drying unit 8, where ink on the front side of the sheet is dried. Subsequently, the sheet is introduced into the path (the second path) extending to the reversing unit 9, not into the path (the third path) extending to the discharge-conveyance unit 10. The sheet introduced into the second path is wound around the winding rotary member of the reversing unit 9 that rotates in the forward direction (the counterclockwise direction in FIG. 4). When predetermined front-side printing by the printing unit 4 is finished, the continuous sheet is cut at the trailing end of the entire printed portion thereof by the cutting unit 6. The portion of the continuous sheet that is on the downstream side in the conveyance direction with respect to the cut position (the printed portion of the continuous sheet) is dried by the drying unit 8 and is wound up to the trailing end (the cut end) thereof by the reversing unit 9. Simultaneously with the winding, the portion of the continuous sheet remaining on the upstream side in the conveyance direction with respect to the cut position (the portion of the continuous sheet on the side of the printing unit 4) is rewound into the sheet feeding unit 1 such that the leading end (the cut end) of the sheet is not left in the decurling unit 2, thereby being wound into the roll R1 or R2. With such rewinding, the rewound portion of the sheet is prevented from interfering with the sheet that is refed in the back-side printing sequence described below.

After the front-side printing sequence described above, the operation proceeds to the back-side printing sequence. Specifically, the winding rotary member of the reversing unit 9 is rotated in the backward direction (the clockwise direction in FIG. 4) opposite to the direction at the time of winding. Thus, the end of the wound sheet (the trailing end at the time of winding becomes the leading end at the time of refeeding) is fed into the decurling unit 2 along the path shown by the broken line in FIG. 4. In the decurling unit 2, the curl of the sheet produced when the sheet is wound around the winding rotary member is corrected. Specifically, the decurling unit 2, which is provided between the sheet feeding unit 1 and the printing unit 4 in the first path and between the reversing unit 9 and the printing unit 4 in the second path, functions as a common unit that performs decurling in the first and second paths. The sheet whose front and back sides have been reversed is conveyed to the skew correcting unit 3 and then to the printing unit 4, where printing is performed on the back side of the sheet. The printed sheet is conveyed to the inspecting unit 5 and then to the cutting unit 6, where the sheet is cut into pieces of predetermined unit lengths. The cut pieces of the sheet obtained in such a manner each have images printed on the front and back sides thereof. Therefore, recording by the information recording unit 7 is not performed. The cut sheets are each conveyed to the drying unit 8 and then to the discharge-conveyance unit 10, are sorted by the sorting unit 11, and are sequentially discharged and stacked onto the discharge unit 12 of the sorting unit 11. Thus, in duplex printing, the sheet is conveyed and processed along the first path, the second path, the first path, and the third path in that order.

Figure 5:
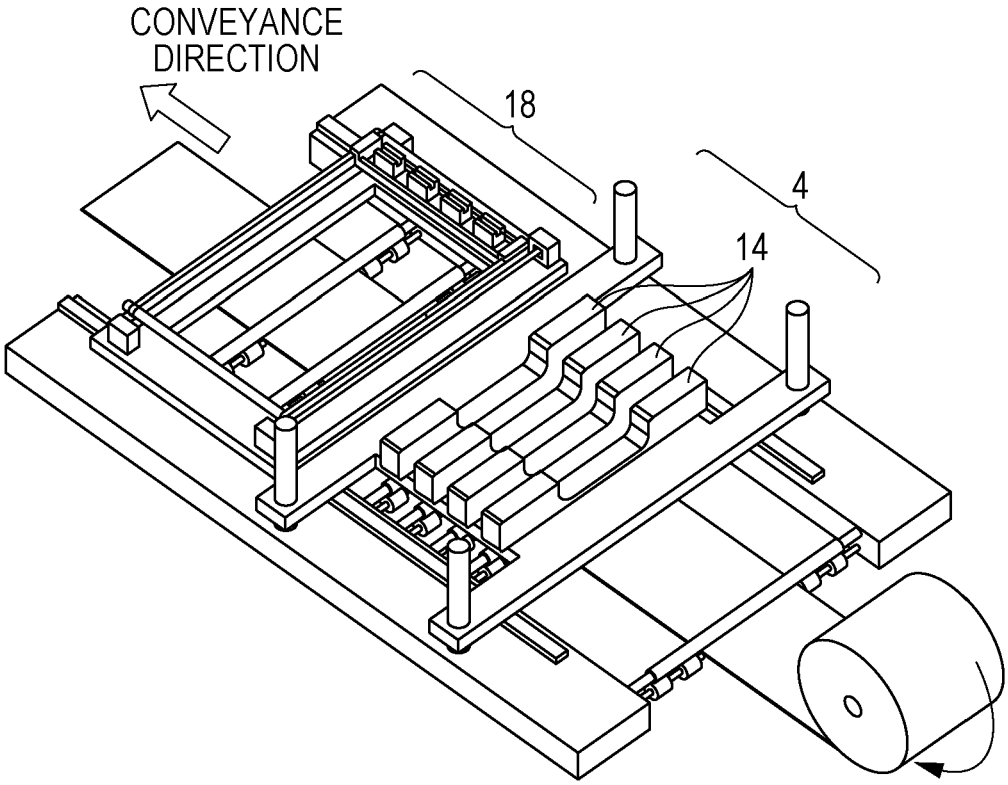
FIG. 5 is a perspective view showing relevant parts of the printing apparatus in a printing state.

FIG. 5 is a perspective view showing relevant parts of the printing apparatus in a printing state. As described above, the print heads 14 are arranged parallel to each other and side by side in the conveyance direction. As shown in FIG. 5, four print heads 14 provided for four colors of cyan (C), magenta (M), yellow (Y), and black (K) are provided. A cleaning unit 18 performs an operation of cleaning the print heads 14. In the printing state where printing is being performed on the sheet with the print heads 14, the cleaning unit 18 is on the downstream side in the conveyance direction with respect to the printing unit 4. The cleaning unit 18 includes wipers that wipe the nozzle surfaces of the print heads 14, caps that cap the nozzle surfaces of the print heads 14 so that suction is applied for removal of ink from the print heads 14, and so forth.

Figure 6A:
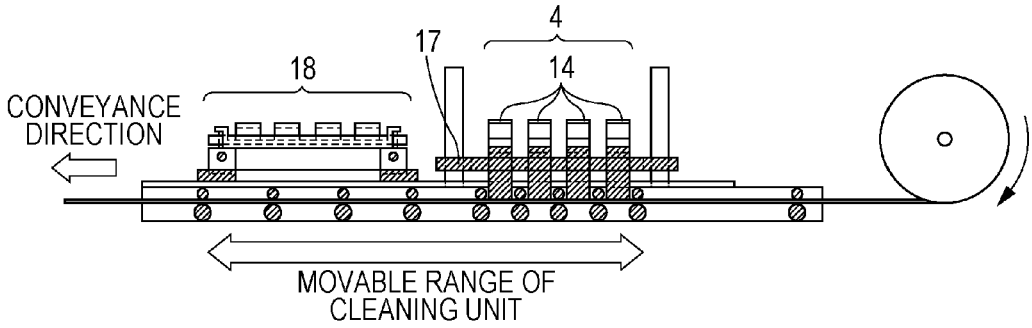
FIG. 6A is a cross-sectional view showing relevant parts of the printing apparatus in the printing state.
Figure 6B:
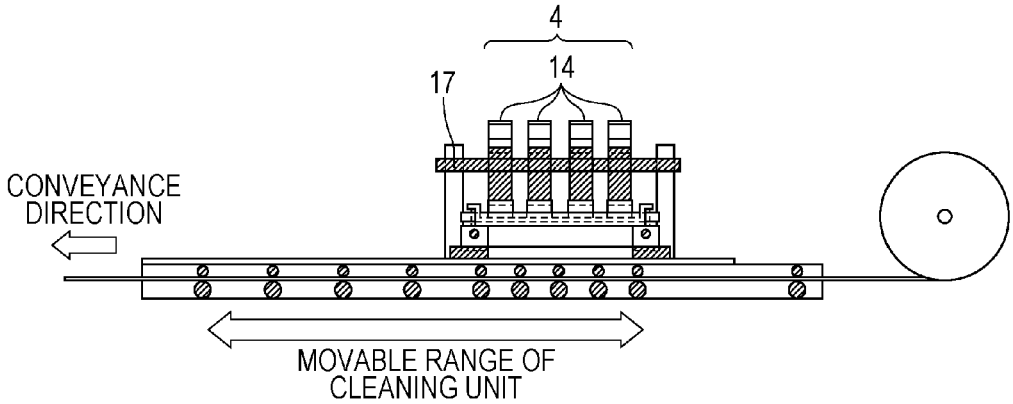
FIG. 6B is a cross-sectional view showing relevant parts of the printing apparatus in a cleaning state.

FIG. 6A is a cross-sectional view showing relevant parts of the printing apparatus in the printing state. FIG. 6B is a cross-sectional view showing relevant parts of the printing apparatus in a cleaning state. The print heads 14 are held by a common head holder 17. The head holder 17 is movable upward and downward, thereby being capable of changing the distance between the sheet and the print heads 14. In the printing state, the print heads 14 are at a first position that is near the sheet. When the state of the printing apparatus is changed from the printing state to the cleaning state, the head holder 17 is moved upward, whereby the print heads 14 are moved to a second position that is remote from the sheet. Furthermore, the cleaning unit 18 that has been on the downstream side in the conveyance direction with respect to the printing unit 4 is moved along rails (not shown) so as to be positioned under the print heads 14. Subsequently, cleaning of the print heads 14 is performed by wiping the nozzle surfaces of the print heads 14 with the wipers, capping the nozzle surfaces of the print heads 14 with the caps, and so forth.

Figure 7:
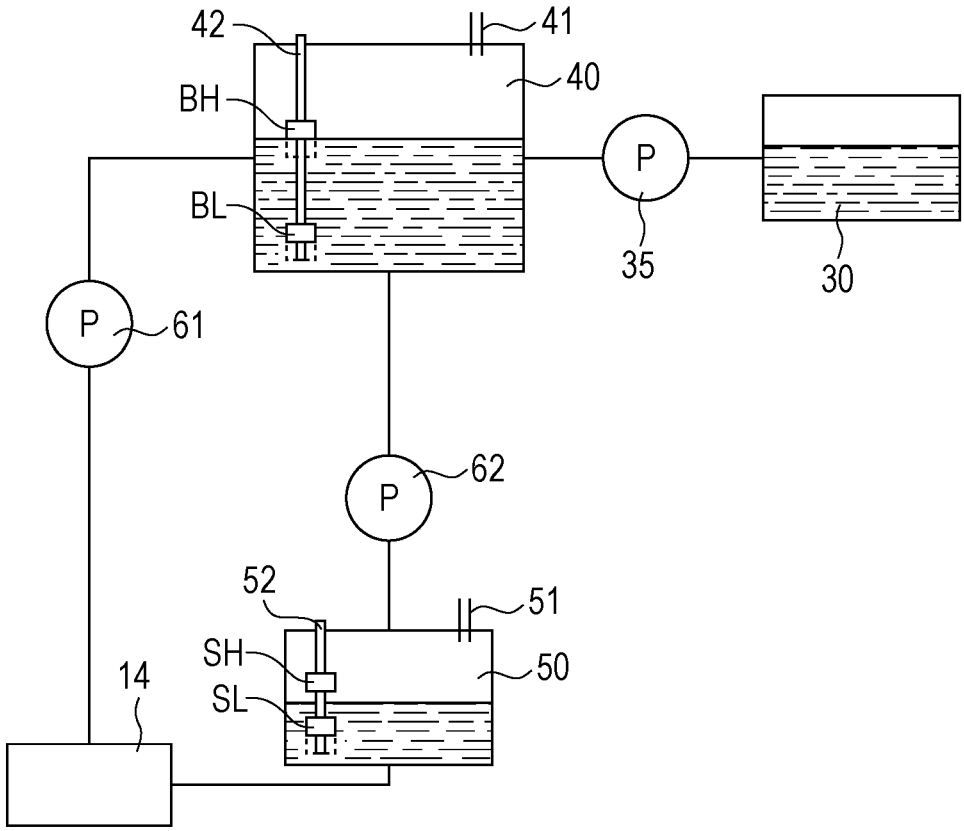
FIG. 7 is a diagram showing an ink circulatory supply mechanism.

FIG. 7 is a diagram showing an ink circulatory supply mechanism. In the embodiment, as described above, four print heads 14 for the colors of C, M, Y, and K are provided. Each of the print heads 14 is provided with the ink circulatory supply mechanism. FIG. 7 shows one of the ink circulatory supply mechanisms all of which have the same configuration.

Referring to FIG. 7, an ink tank 30 contains ink to be supplied to the print head 14. The ink tank 30 is attachable to and detachable from the body of the printing apparatus. The ink in the ink tank 30 is first supplied to a buffer tank 40, which is a first storage tank. The ink in the buffer tank 40 is then supplied to a sub-tank 50, which is a second storage tank. The ink in the sub-tank 50 is lastly supplied to the print head 14.

The buffer tank 40 is provided at the highest position in an ink circulatory supply path. The level at which the print head 14 is positioned is changed between when printing is performed on the sheet and when cleaning is performed. The sub-tank 50 is provided at such a position that ink does not spill from the nozzles of the print head 14 and air does not flow into the nozzles whichever level the print head 14 is positioned at.

The ink in the ink tank 30 is supplied to the buffer tank 40 with a supply pump 35. A first circulation pump 61 is provided in a portion of the circulatory supply path between the print head 14 and the buffer tank 40. When the first circulation pump 61 is driven, the ink in the sub-tank 50 is supplied to the print head 14, and the ink in the print head 14 that has not been used for printing is collected to the buffer tank 40. A second circulation pump 62 is provided in a portion of the circulatory supply path between the buffer tank 40 and the sub-tank 50. When the second circulation pump 62 is driven, the ink in the buffer tank 40 is supplied to the sub-tank 50.

The first circulation pump 61, the second circulation pump 62, and the supply pump 35 are each a tube pump capable of producing a pressure by rotating a roller in such a manner as to squeeze a tube. The pumps 61, 62, and 35 are driven by stepping motors.

The buffer tank 40 has an atmosphere communication port 41 at the top thereof. A buffer-tank overflow tube 45, described below, is connected to the atmosphere communication port 41. In FIG. 7, the buffer-tank overflow tube 45 is omitted for the convenience of description of the ink circulatory supply mechanism. A buffer-tank sensor 42, which is a second liquid-level detector (a second detector), includes a shaft fixed to the buffer tank 40, and a buffer-tank upper float BH and a buffer-tank lower float BL that are movable upward and downward within specific ranges along the shaft extending therethrough. The buffer-tank upper float BH and the buffer-tank lower float BL each have a specific gravity larger than that of air and smaller than that of ink. Therefore, when the level of the ink surface rises, the float BH or BL moves upward. The upward movement of each of the floats BH and BL is limited by a limiter to a specific position. When the level of the ink surface falls, the float BH or BL moves downward. The downward movement of each of the floats BH and BL is limited by a limiter to a specific position. Magnetic switches are provided inside the shaft. While the float BH or BL moves upward or downward with the change in the level of the ink surface, a corresponding one of the magnetic switches detects the position of the float BH or BL. Thus, the level of the ink surface is detected.

The sub-tank 50 has an atmosphere communication port 51 at the top thereof. A sub-tank overflow tube 55, described below, is connected to the atmosphere communication port 51. In FIG. 7, the sub-tank overflow tube 55 is omitted for the convenience of description of the ink circulatory supply mechanism. A sub-tank sensor 52, which is a first liquid-level detector, includes a shaft, a sub-tank upper float SH, and a sub-tank lower float SL, as the buffer-tank sensor 42 does.

The liquid level detectors described in the embodiment are the buffer-tank sensor 42 and the sub-tank sensor 52. The liquid level detectors may be of another configuration. For example, the liquid level detectors may be each a capacitive sensor in which the liquid level is detected from changes in the potentials of sensing portions provided at two ends of the tank.

The ink capacity of the buffer tank 40 is larger than that of the sub-tank 50. Furthermore, the ink capacity in a portion of the buffer tank 40 from the buffer-tank lower float BL to the buffer-tank upper float BH of the buffer-tank sensor 42 is larger than that of a portion of the sub-tank 50 from the sub-tank lower float SL to the sub-tank upper float SH of the sub-tank sensor 52.

Figure 8:
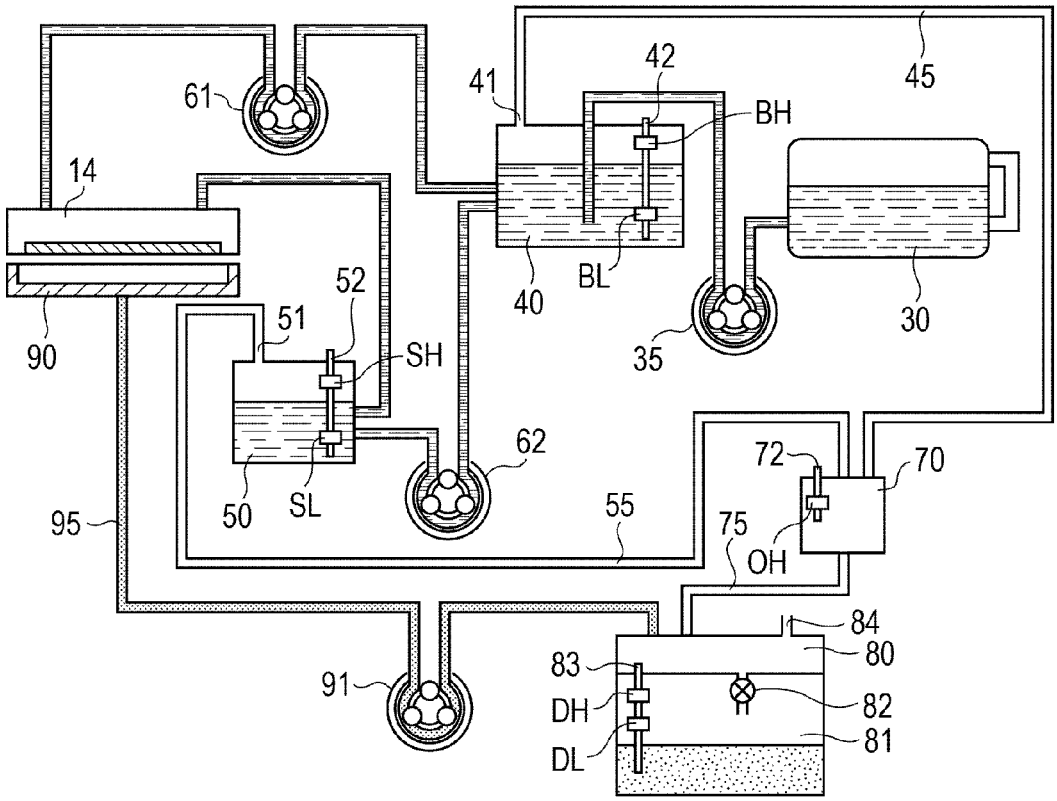
FIG. 8 is a diagram showing an ink draining mechanism.

FIG. 8 is a diagram showing an ink draining mechanism. Referring to FIG. 8, the buffer-tank overflow tube 45 is connected to the atmosphere communication port 41 of the buffer tank 40 and functions as a first overflow tube into which ink overflowed from the buffer tank 40, i.e., the first storage tank, flows. The sub-tank overflow tube 55 is connected to the atmosphere communication port 51 of the sub-tank 50 and functions as a second overflow tube into which ink overflowed from the sub-tank 50, i.e., the second storage tank, flows. The buffer-tank overflow tube 45 and the sub-tank overflow tube 55 are connected to an overflow tank 70. The overflow tank 70 is common to all of the print heads 14.

In the embodiment, ink is circulated among the buffer tank 40, the sub-tank 50, and the print head 14 while being ejected from the print head 14. During the circulation, the driving of the first circulation pump 61 and the second circulation pump 62 is controlled while the levels of the ink surfaces in the buffer tank 40 and the sub-tank 50 are detected with the buffer-tank sensor 42 and the sub-tank sensor 52, respectively. Therefore, ink does not usually overflow from the buffer tank 40 and the sub-tank 50. If the buffer-tank sensor 42 and/or the sub-tank sensor 52 fail, however, the levels of the ink surfaces in the buffer tank 40 and/or the sub-tank 50 may not be detected correctly, and ink may overflow from the buffer tank 40 and/or the sub-tank 50. Any ink overflowed from the buffer tank 40 flows into the buffer-tank overflow tube 45 and is collected into the overflow tank 70. Any ink overflowed from the sub-tank 50 flows into the sub-tank overflow tube 55 and is collected into the overflow tank 70.

An overflow-tank sensor 72 detects the level of the ink surface in the overflow tank 70. The overflow-tank sensor 72 includes a shaft fixed to the overflow tank 70 and an overflow-tank float OH that is movable upward and downward within a specific range along the shaft extending therethrough. The overflow-tank float OH has a specific gravity larger than that of air and smaller than that of ink. Therefore, when the level of the ink surface rises, the float OH moves upward. The upward movement of the float OH is limited by a limiter to a specific position. When the level of the ink surface falls, the float OH moves downward. The downward movement of the float OH is limited by a limiter to a specific position. A magnetic switch is provided inside the shaft. The magnetic switch detects that the float OH has moved upward or downward with the change in the level of the ink surface. If it is detected that the overflow-tank float OH has moved, it is regarded that ink has overflowed from the buffer tank 40 and/or the sub-tank 50. That is, the overflow-tank sensor 72 can detect the occurrence of overflow of ink. If the occurrence of overflow of ink is detected, the control unit 13 stops the driving of the supply pump 35, the first circulation pump 61, and the second circulation pump 62. Furthermore, a notifying unit notifies that the ink has overflowed.

An overflowed-ink drain tube 75 is connected to the overflow tank 70 and a first drain tank 80, described below. When the amount of ink in the overflow tank 70 exceeds a specific value, the ink in the overflow tank 70 is drained to the first drain tank 80. Specifically, the ink is drained to the first drain tank 80 such that a specific amount of ink remains in the overflow tank 70. Thus, the detection by the overflow-tank sensor 72 is performed normally.

The ink drained from the overflow tank 70 is temporarily collected into the first drain tank 80 to which the overflowed-ink drain tube 75 is connected. A second drain tank 81 is attachable to and detachable from the first drain tank 80. The first drain tank 80 and the second drain tank 81 are common to all of the print heads 14. The second drain tank 81 has a larger capacity than the first drain tank 80. A valve mechanism 82 is provided at the connection between the first drain tank 80 and the second drain tank 81. When the second drain tank 81 is mounted on the printing apparatus, the valve mechanism 82 is open, allowing the first drain tank 80 and the second drain tank 81 to communicate with each other on the inside thereof. When the second drain tank 81 is not mounted on the printing apparatus, the valve mechanism 82 is closed. In this state, since the first drain tank 80 and the second drain tank 81 are both closed, the second drain tank 81 can be replaced.

A drain-tank sensor 83 detects the level of the ink surface in the second drain tank 81. The train-tank sensor 83 includes a shaft fixed to the second drain tank 81, and a drain-tank upper float DH and a drain-tank lower float DL that are movable upward and downward within specific ranges along the shaft extending therethrough. The drain-tank upper float DH and the drain-tank lower float DL each have a specific gravity larger than that of air and smaller than that of ink. Therefore, when the level of the ink surface rises, the float DH or DL moves upward. The upward movement of each of the floats DH and DL is limited by a limiter to a specific position. When the level of the ink surface falls, the float DH or DL moves downward. The downward movement of each of the floats DH and DL is limited by a limiter to a specific position. Magnetic switches are provided inside the shaft. While the float DH or DL moves upward or downward with the change in the level of the ink surface, a corresponding one of the magnetic switches detects the position of the float DH or DL. Thus, the level of the ink surface is detected.

When it is detected that the state of the drain-tank lower float DL has changed from the off state to the on state, it is notified that the second drain tank 81 will become full shortly. That is, the near-end state is detected. When more ink is collected into the second drain tank 81 and it is detected that the state of the drain-tank upper float DH has changed from the off state to the on state, it is determined that the second drain tank 81 has become full, and an instruction advising replacing the second drain tank 81 is given. That is, the full state is detected. By replacing the second drain tank 81 that has become full with another second drain tank 81 that is empty, the printing apparatus can be used for a longer time.

The first drain tank 80 has an atmosphere communication port 84 at the top thereof. Air collected in the first drain tank 80 is discharged from the atmosphere communication port 84 to the outside of the first drain tank 80. Air in the buffer tank 40 flows into the buffer-tank overflow tube 45, the overflow tank 70, the overflowed-ink drain tube 75, and the first drain tank 80, and is discharged from the atmosphere communication port 84. Meanwhile, air in the sub-tank 50 flows into the sub-tank overflow tube 55, the overflow tank 70, the overflowed-ink drain tube 75, and the first drain tank 80, and is discharged from the atmosphere communication port 84.

Each of the print heads 14 is provided with a cap 90. The cap 90 is configured to cap the nozzle surface of the print head 14. A drain tube 95 is connected to the cap 90 so as to drain ink from the cap 90. A suction pump 91 produces a negative pressure inside the cap 90. The suction pump 91 is a tube pump capable of producing a pressure by rotating a roller in such a manner as to squeeze the drain tube 95. The suction pump 91 is driven by a stepping motor. The drain tube 95 is connected to the first drain tank 80. Thus, the ink taken from the print head 14 by suction is also collected into the first drain tank 80.

Figure 9:
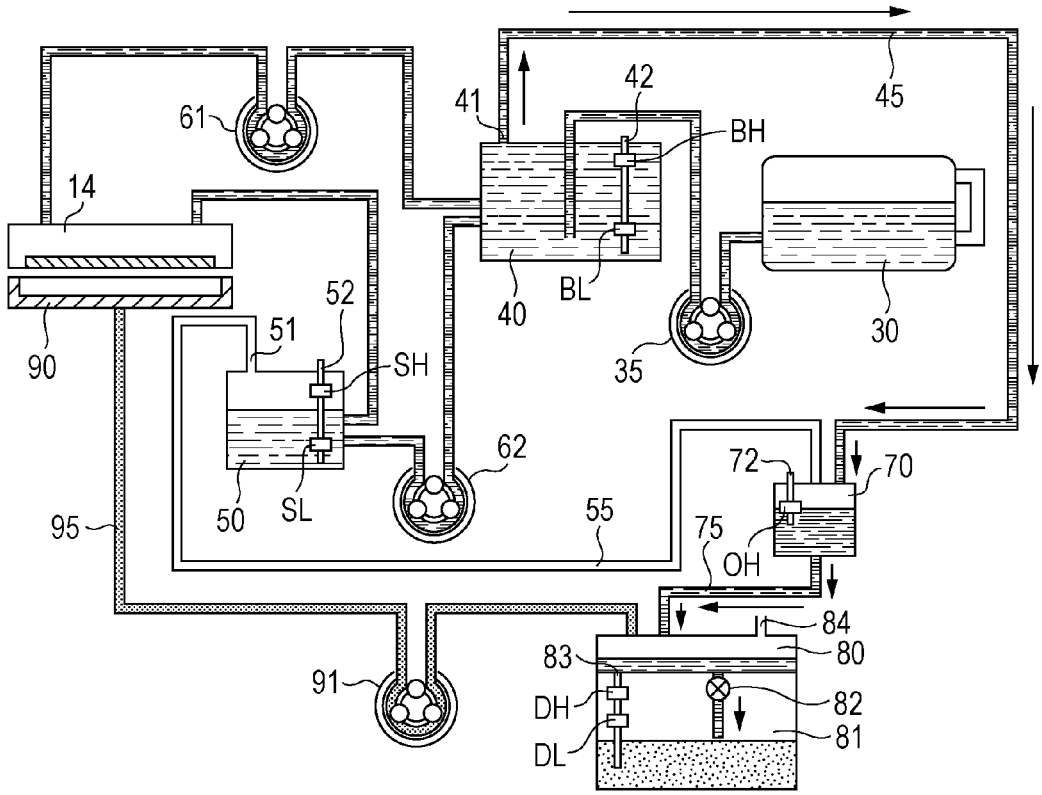
FIG. 9 is a diagram showing a state where ink is overflowing from a buffer tank.

FIG. 9 is a diagram showing a state where ink is overflowing from the buffer tank 40. If ink overflows from the buffer tank 40 because of, for example, failure of the buffer-tank sensor 42, i.e., the second liquid-level detector, the ink flows out through the atmosphere communication port 41 into the buffer-tank overflow tube 45. The ink flowed into the buffer-tank overflow tube 45 further flows into the overflow tank 70. When the overflow-tank sensor 72 detects that the ink has flowed into the overflow tank 70, information that the overflow of ink has occurred is transmitted to the control unit 13. The control unit 13 stops the driving of the supply pump 35, the first circulation pump 61, and the second circulation pump 62. Furthermore, the notifying unit notifies that the ink has overflowed.

The ink flowed into the overflow tank 70 is delivered to the first drain tank 80 through the overflowed-ink drain tube 75. As described above, the ink drained from the cap 90 is also delivered to the first drain tank 80.

Figure 10:
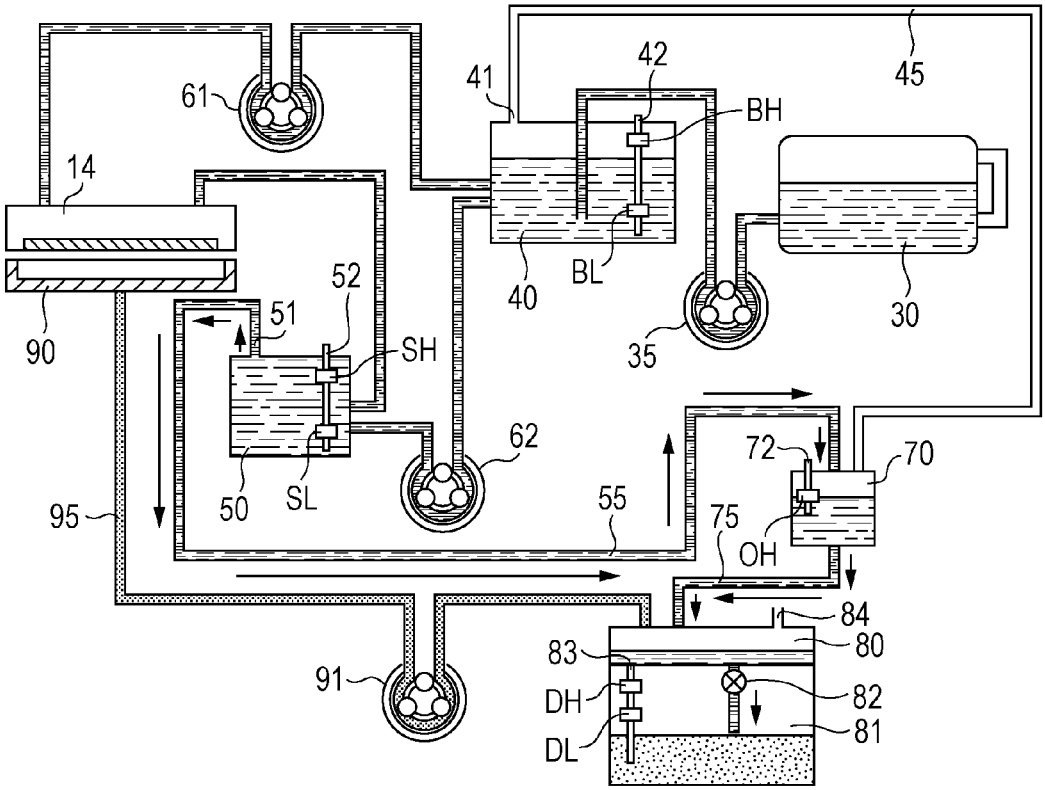
FIG. 10 is a diagram showing a state where ink is overflowing from a sub-tank.

FIG. 10 is a diagram showing a state where ink is overflowing from the sub-tank 50. If ink overflows from the sub-tank 50 because of, for example, failure of the sub-tank sensor 52, i.e., the first liquid-level detector, the ink flows out through the atmosphere communication port 51 into the sub-tank overflow tube 55. The ink flowed into the sub-tank overflow tube 55 further flows into the overflow tank 70. When the overflow-tank sensor 72 detects that the ink has flowed into the overflow tank 70, information that the overflow of ink has occurred is transmitted to the control unit 13. The ink flowed into the overflow tank 70 is delivered to the first drain tank 80 through the overflowed-ink drain tube 75.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-115495 filed May 19, 2010, which is hereby incorporated by reference herein in its entirety.

What is claimed is:

1. A printing apparatus having a print head configured to eject ink, a first storage tank configured to store the ink, and a second storage tank configured to store the ink supplied from the first storage tank and to supply the ink to the print head, ink that has not been ejected from the print head being collected into the first storage tank, the printing apparatus comprising:

a first overflow tube into which ink overflowed from the first storage tank flows;

an overflow tank to which the first overflow tube is connected;

a drain tank to which ink is drained from the overflow tank; and an atmosphere communication port provided to the drain tank, wherein the first storage tank communicates with the atmosphere through the first overflow tube, the overflow tank, the drain tank, and the atmosphere communication port.

2. A printing apparatus according to claim 1, wherein the drain tank includes a first drain tank into which the ink drained from the overflow tank is temporarily collected and a second drain tank attachable to and detachable from the first drain tank.

3. A printing apparatus according to claim 1, further comprising a drain-tank sensor configured to detect the level of an ink surface in the drain tank, the drain-tank sensor being capable of detecting that the drain tank is full.

4. A printing apparatus according to claim 1, further comprising a cap configured to cap a nozzle surface of the print head, wherein ink drained from the cap is collected into the drain tank.

5. A printing apparatus according to claim 1, further comprising an overflow-tank sensor configured to detect the level of an ink surface in the overflow tank, the overflow-tank sensor being capable of detecting the occurrence of overflow of the ink.

6. A printing apparatus according to claim 5, wherein, when the occurrence of overflow of the ink is detected by the overflow-tank sensor, a notifying unit notifies the occurrence of overflow of the ink.

7. A printing apparatus according to claim 1, further comprising a second overflow tube into which ink overflowed from the second storage tank flows, the second overflow tube being connected to the overflow tank.

8. A printing apparatus according to claim 7, wherein the second storage tank communicates with the atmosphere through the atmosphere communication port.

* * * * *